United States Patent [101]

Noda

[11] 4,052,774

[45] Oct. 11, 1977

[54] PLASTIC BUCKLE

[75] Inventor: Taizo Noda, Nishinomiya, Japan

[73] Assignee: Kohshoh Limited, Kyoto, Japan

[21] Appl. No.: 745,002

[22] Filed: Nov. 26, 1976

[51] Int. Cl.[2] ..... A44B 13/00; A44B 21/00

[52] U.S. Cl. ..... 24/201 A; 24/201 HH; 24/201 R

[58] Field of Search ..... 24/201 HH, 201 BN, 201 A, 24/201 R, 201 CP, 230 TC, 75

[56] References Cited

U.S. PATENT DOCUMENTS

| | | | |
|---|---|---|---|
| 3,327,362 | 6/1967 | Bousquet | 24/201 HH |
| 3,520,033 | 7/1970 | Usuda | 24/201 D |

*Primary Examiner*—Bernard A. Gelak

[57] ABSTRACT

A plastic buckle comprises a pair of plastic engaging elements of the same shape each of which includes a plate portion, a base plate portion extended from the longitudinal edge of the plate portion, and two engaging portions extended integrally from the edge of the base plate portion, whereby the buckle can connect the ends of a belt or the like through the engagement of the engaging portions by simple operation.

9 Claims, 7 Drawing Figures

PLASTIC BUCKLE

The present invention relates to a plastic buckle to be attached to the ends of a belt or the like for connecting the same.

A conventional buckle e.g. one disclosed in U.S. Pat. No. 3,520,033 comprises two elements of the same form molded of synthetic resin adapted to be connected together as male and female members, in which a fitting portion is provided at the middle of the front portion of each plate portion of the members, the flat portions on either side of the fitting portion being stepped with respect to each other, and the lower surface of the upper step and the upper surface of the lower step are located to be substantially in the same plane, one of said surfaces being provided with an opening and the other surface with a projection. In this conventional buckle, the male and female members are connected only by the engagement between the opening and the projection, and therefore the positions of the opening and the projection have to be correctly determined with respect to each other. Unless they are formed at the correct positions, the members are apt to be disconnected or sometimes they cannot be connected. Further, when the opening or the projection is deformed due to wear or the like, the male and female members are easily disconnected. In conclusion, in this buckle, no sufficient attention has been paid to the connecting means.

Another type buckles are formed of metal in general, large in thickness and not so smart in shape. Therefore, they provide uncomfortable feeling to the wearer in use, and are therefore unsuitable for the application to lingeries and others.

A buckle according to the present invention has been obtained after long studies in view of the abovementioned respects.

An object of the present invention is to provide a plastic buckle which can surely connect the ends of a belt or the like only by simple operation.

Another object of the present invention is to provide a plastic buckle which can be molded with a single mold, formed to be smallest in size of the buckles of this type, and therefore obtained at a low cost, thus being smart and providing comfortable feeling to the wearer in use.

Therefore, a further object of the present invention is to provide a plastic buckle comprising a pair of plastic engaging elements formed of synthetic resin in each of which a plate portion, a base plate portion and engaging portions integrally formed.

The plate portion is provided with a means for attaching a belt or the like thereto. Such a means for attachment is not required when the buckle is molded with an end portion of a belt or the like embedded in the plate portion thereof. However, a plastic buckle and a belt or the like are generally separately manufactured, and therefore this means for attachment has an important function. The base plate portion comprises one or two extended portions from the longitudinal edge of the plate portion, one surface of the base plate portion being substantially in the same plane with the plate portion and the other surface is at such a level as corresponding to substantially half the thickness of the plate portion. Such a construction of the plate portion and the base plate portion permits the buckle extremely thin and free of uneveness. The engaging portions are extended from the edge of the base plate portion so as to be in parallel with the longitudinal side edge of the plate portion and so as to have the surfaces substantially in the same plane with those of the plate portion respectively. The engaging portions function substantially to connect the pair of plastic engaging elements with each other. Therefore, the width of the upper surface of each engaging portion defined by the upper edges of the inner and outer sides thereof respectively is somewhat larger than that of the space defined by the inner edge of the engaging portion and the corresponding inner edge of the plate portion. By thus forming each engaging portion, the pair of engaging elements are prevented from being unintentionally easily disengaged, and the engagement therebetween is well retained even if the belt or the like is somewhat loosened. For this engagement and disengagement, elastic property of the plastic material is effectively made use of. That is, the engaging and disengaging operations are achieved by somewhat deforming the engaging portions. Further, for obtaining a perfect engagement, a fitting means is provided integrally with the inside of each engaging portion. With this fitting means, the engagement between the pair of plastic engaging elements can be further ensured as well as the positioning of the plastic engaging elements.

Other advantages of the present invention will be apparent from the following description of preferred embodiments of the invention given with reference to the appended drawings. Similar numerals in the drawings indicate similar members or portions, and the repeated description of similar functions and the like are omitted.

Figure 1:
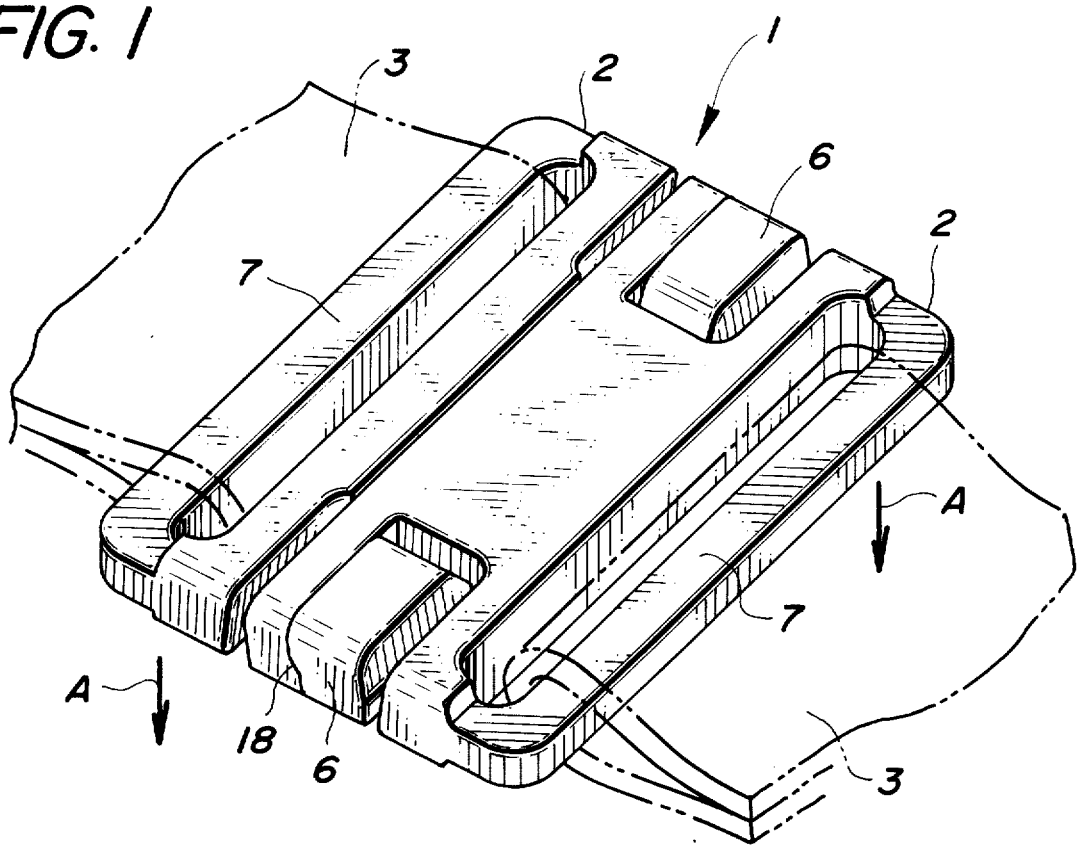
FIG. 1 is a perspective view of a preferred embodiment of a plastic buckle according to the present invention.
Figure 2:
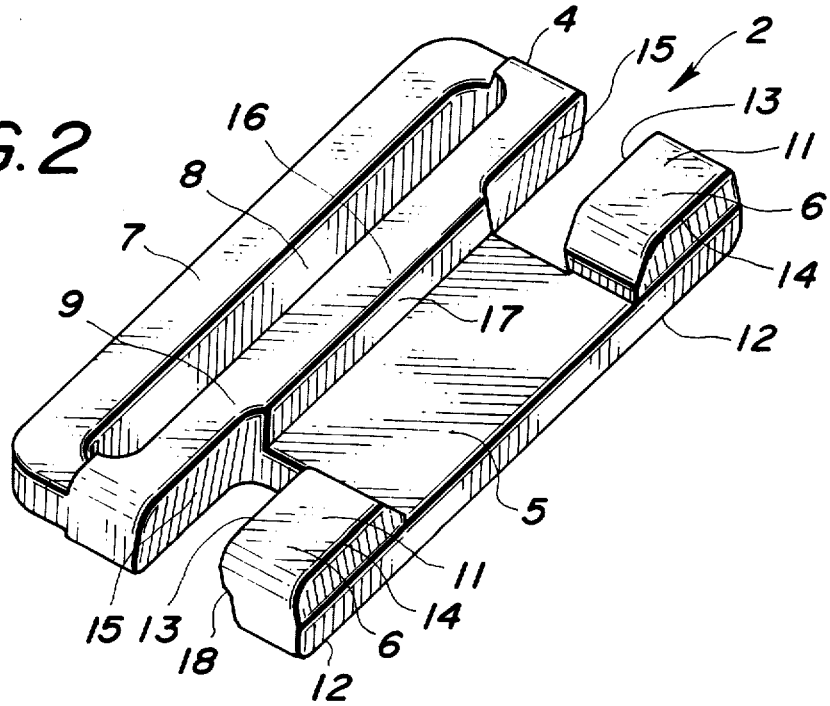
FIG. 2 is a perspective view seen from above of a plastic engaging element of the buckle of FIG. 1.
Figure 3:
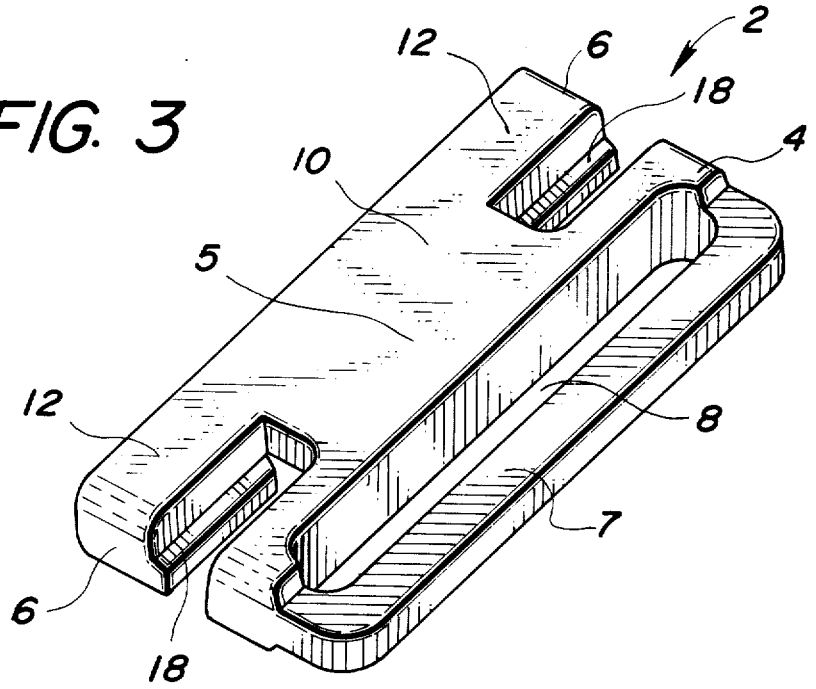
FIG. 3 is a perspective view seen from below of the plastic engaging element of the buckle of FIG. 1.
Figure 4:
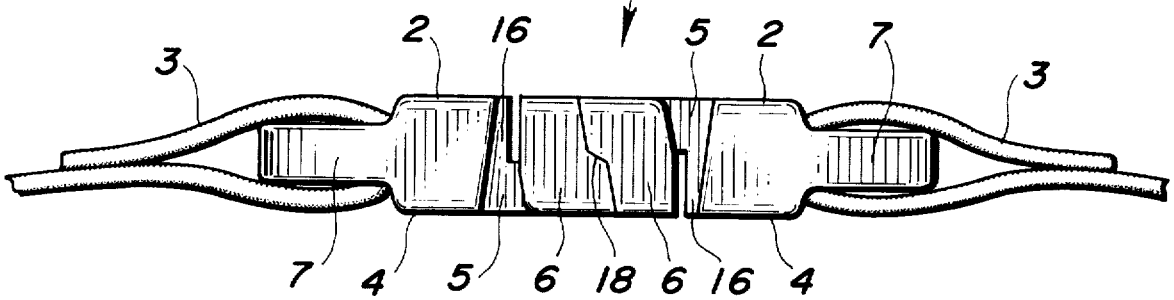
FIG. 4 is a side view of the buckle of FIG. 1.

In FIGS. 1 to 4, a plastic buckle 1 comprising two plastic engaging elements 2, 2 is adapted to connect two looped end portions 3, 3 of a belt or the like together by means of the engaging function of the plastic engaging elements. The two plastic engaging elements 2, 2 are formed in the same shape. The plastic engaging element 2 comprises a plate portion, a base plate portion 5 and two engaging portions 6, 6, all of which are preferably integrally molded of plastic material having a certain degree of strength and elasticity. The thickness of the plate portion 4 may be uniform throughout the same but preferably at least the portion 7 to be covered with the end portion 3 of a belt or the like is formed smaller in thickness than the remaining portion. By forming the plate portion in such a shape, the end of a belt or the like are prevented from being raised at the portion 7, thus providing comfortable feeling to the wearer in use. The plate portion 4 is provided with a means for attaching the end 3 of a belt or the like thereto comprising a slit.

The end of a belt or the like is passed through the slit to form the end portion 3.

The base plate portion 5 is smaller in width than the plate portion 4, extended from the substantially middle portion of the longitudinal side edge 9 of the plate portion 4 and formed to have a thickness half the thickness of the plate portion 4. Further, one surface 10 of the base plate portion 5 is substantially in the same plane with one surface of the plate portion 4. Two surfaces 11, 12 of each engaging portion 6 extended outwardly from the edge of the base plate portion 5 so as to be in parallel with the longitudinal side edge 9 of the plate portion 4 are formed substantially in the same plane with two surfaces of the plate portion 4 respectively.

The width of the upper surface 11 of each engaging portion 6 defined by the upper edges of the inner side 13 and the outer side 14 is a little larger than the width of the space defined by the inner edge 13 of the engaging portion 6 and the inner edge 15 of the plate portion 4. By thus forming each engaging portion 6, the engagement is ensured between the plastic engaging elements 2, 2 which are not readily disengaged even if the belt or the like is somewhat loosed. Such a relation as abovementioned may be provided to a projection 16 integrally formed with the longitudinal edge 9 of the plate portion 4. That is, the upper surfaces 11, 11 defined by the inner edges 13, 13 and the outer edges 14, 14 may be formed somewhat larger in width than the space defined by the inner edges 13, 13 and the inner edges 17 of the projection 16. With such a construction, in engaging the plastic engaging elements 2, 2, the engaging portions 6, 6 are somewhat freely deformable in the space, so that they are easily settled in the engaged state and similarly prevented from being readily disengaged unintentionally. Each engaging portion 6 is provided at the inside thereof with a fitting means comprising a longitudinally elongated step portion 18. With this fitting means 18, the position of the engagement between the plastic engaging elements 2, 2 is surely determined and the elements 2, 2 are prevented from being disengaged since the engaging portion 6 does not slip even if the plastic buckle 1 is pulled with strong force through the belt or the like.

A plastic buckle 1 having the abovementioned construction is put into use by engaging and disengaging the plastic engaging elements thereof in the following manner. The corresponding surfaces of the base plate portions 5, 5 not in the same plane with the surface of the plate portion 4 are opposed and then the two plastic engaging elements 2, 2 are superposed and pushed toward each other so that the upper edges 13, 13 of the inner sides of the engaging portions 6, 6 are engaged with each other. As the result, since each plastic engaging element 2 has an elastic property, each engaging portion is deformed toward the plate portion of the other engaging element, and the engaging portions 6, 6 of the engaging elements 2, 2 are engaged at the step portions thereof 18, 18. On the other hand, for disengaging the two engaging elements 2, 2 from each other, the plate portions 4, 4 of the two engaging elements 2, 2 are twisted in the opposite directions i.e. the direction of the arrow A, and thereby the engaging portions 6, 6 in engagement with each other at the step portions 18, 18 are deformed toward the plate portion of the other engaging element and then disengaged.

Figure 5:
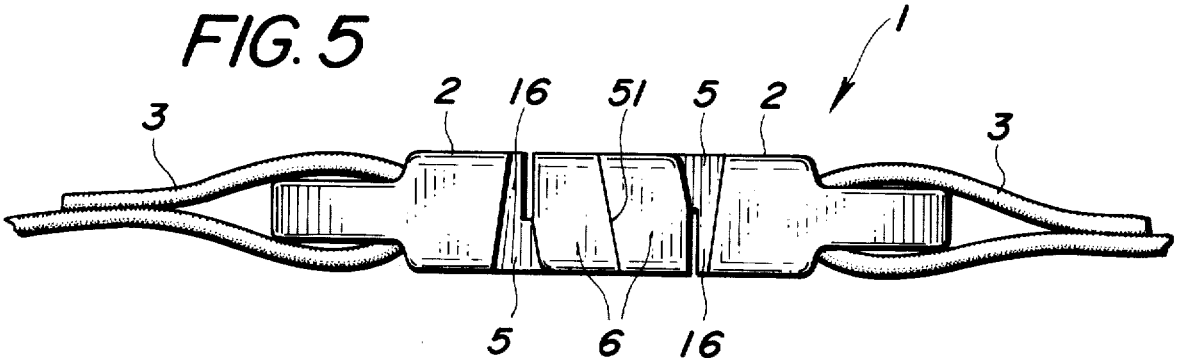
FIG. 5 is a side view of a modification of the plastic buckle of FIG. 1, especially for illustrating a modification of the fitting means thereof.

In FIG. 5, there is shown a modified embodiment of the fitting means. The fitting means comprises an inclined surface portion 51 which is uniformly provided longitudinally throughout the inside of each engaging portion 6. With this inclined surface portion 51, similar effect is obtained to that of the abovementioned fitting means comprising a step portion, of course.

Figure 6:
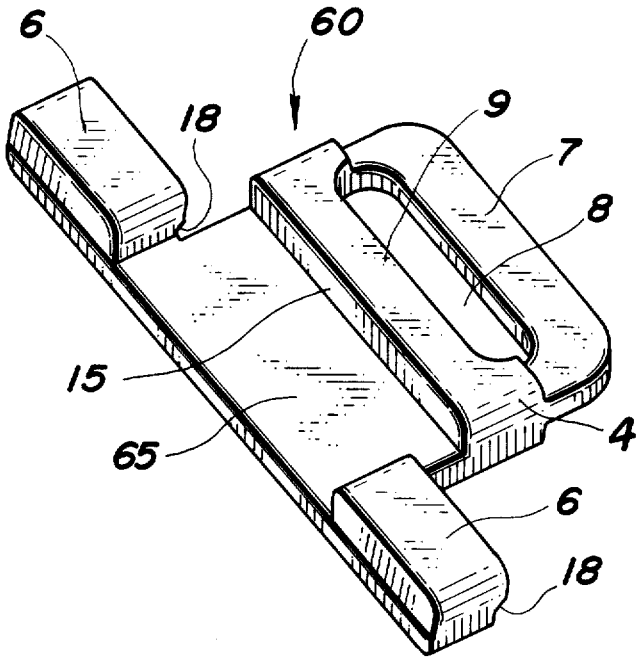
FIG. 6 is a perspective view of a plastic engaging element of another preferred embodiment of a plastic buckle according to the present invention.

In FIG. 6, there is shown a modification of the plastic engaging element. This element 60 comprises portions similar to those of the element 2, i.e. a plate portion 4, a base plate portion 65 and the engaging portions 6, 6. However, the element 60 is different from the element 2 only in the fact that the base plate portion 65 of the element 60 is formed to be of the same width as the plate portion 4, unlike the base plate portion 5. Therefore, the element 60 is integrally formed in substantially T-shape. The element 60 of such a construction need not be provided with a projection 16 which is preferably provided to the element 2. This is because a plate portion for limiting the deformation of the engaging portions are not so formed as to be in face-to-face relation with the engaging portions.

Figure 7:
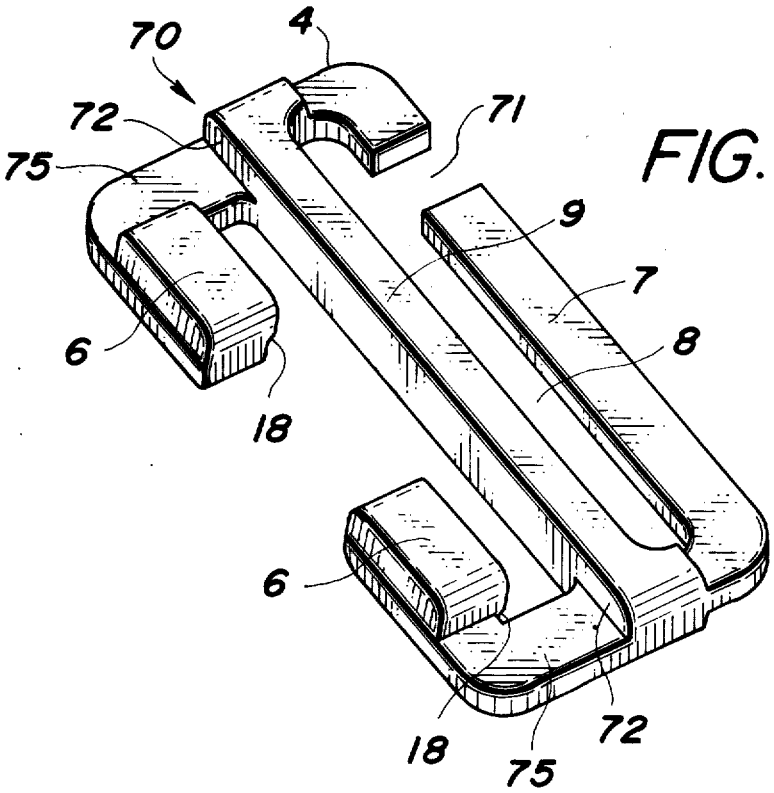
FIG. 7 is a perspective view of a plastic engaging element of another preferred embodiment of a plastic clip according to the present invention.

In FIG. 7, there is shown another modification of a plastic engaging element. In this element 70, base plate portions 75, 75 are extended from the end portions of the longitudinal edge of the plate portion 4 respectively, while the engaging portions 6, 6 are extended inwardly from the end portions of the base plate portions 75, 75 so as to be in parallel with the longitudinal edge of the plate portion. By thus integrally forming the element 70 comprising the base plate 75 and others, similar functions to those mentioned above can be obtained. The element 70 may be provided with a projection 16 which is preferably provided to the element 2. That is, a projection corresponding to the projection 16 may be provided at the two end portions 72, 72 of the longitudinal edges 9. Further, the element 70 may be provided with a cutaway portion 71. By thus providing the cutaway portion 71 to the plate portion 4 so as to be communicated with the slit 8, a looped end of a belt or the like can be easily fitted to the plate portion 4. That is, preliminarily loop-shaped end portion of the belt or the like has only to be inserted through the cutaway portion 71 into the slit 8.

As abovementioned, in a plastic buckle according to the present invention, the engaging elements can be engaged or disengaged by simple operation. Further, since the two engaging elements are in the same form, they can be molded of a mold, thereby affording to obtain the product at a low cost. The fact that the surfaces of the plate portion and the engaging portion are in the same plane prevents the clothes or the like from being damaged and provides comfortableness to wear. Furthermore, the clip can be formed to be the smallest in size of buckles of this type.

What is claimed is:

1. A plastic buckle comprising a pair of plastic engaging elements each of which includes a plate portion having a means for attaching a belt or the like thereto, a base plate portion extended from the longitudinal edge of the plate portion, one surface of the base plate portion being substantially in the same plate with one surface of the plate portion and the other surface thereof at such a level as having the thickness half the thickness of the plate portion, and two engaging portions extended from the edge of the base plate portion so as to be in parallel with the longitudinal edge of the plate portion and so as to have substantially the same planes with those of the plate portion, the plate portion, the base plate portion and the engaging portions being integrally formed, the width of the upper surface of each engaging portion defined by the upper edge of the inner side thereof and the corresponding upper edge of the outer side thereof being somewhat larger than that of the space defined by the upper edge of the inner side of the engaging portion and the corresponding inner edge of the plate portion, each engaging portion being provided at the inside surface thereof with a fitting means.

2. A plastic buckle as claimed in claim 1, in which said means provided at said plate portion for attaching a belt or the like thereto is a slit.

3. A plastic buckle as claimed in claim 1, in which said means provided at said plate portion for attaching a belt or the like thereto is a slit and a cutaway portion communicated with the slit.

4. A plastic buckle as claimed in claim 1, in which said fitting means provided at the inside surface of each engaging portion comprises an inclined surface.

5. A plastic buckle as claimed in claim 1, in which said fitting means provided at the inside surface of each engaging portion comprises a step portion.

6. A plastic buckle as claimed in claim 1, in which said base plate portion is smaller in width than said plate portion and extended from substantially the middle portion of the longitudinal edge of the plate portion, and said engaging portion is extended outwardly from the edge of said base plate portion so as to be in parallel with the longitudinal edge of said plate portion.

7. A plastic buckle as claimed in claim 1, in which said base plate portion has the same width with that of said plate portion, and said engaging portion is extended outwardly from the edge of said base plate portion so as to be in parallel with the longitudinal edge of said plate portion.

8. A plastic buckle as claimed in claim 1, in which said base plate portion is smaller in width than said plate portion and extended from the longitudinal edge of said plate portion, and said engaging portion is extended inwardly from the edge of said base plate portion so as to be in parallel with the longitudinal edge of said plate portion.

9. A plastic buckle as claimed in claim 1, in which at least such a part of said plate portion as covered with a belt or the like is smaller in thickness than the remaining part.

* * * * *